United States Patent [19]

Ganago et al.

[11] Patent Number: 4,559,807

[45] Date of Patent: Dec. 24, 1985

[54] PRESS

[75] Inventors: Oleg A. Ganago; Anatoly V. Safonov; Boris A. Stepanov; Vadim N. Subich; Alexandr D. Frolov, all of Moscow; Nikolai A. Lobanov, Moskovskaya; Yakov L. Lumer, Moskovskaya; Alexei M. Xenofontov, Moskovskaya; Leonid I. Rudman; Alexandr D. Lebed, both of Kiev; Vazha I. Mamatsashvili, Tbilisi; Valery F. Kljuchnikov, Moskovskaya; Dzhemal I. Birkadze, Tbilisi; Sergei S. Shklyarman; Nikolai A. Gordeev, both of Moskovskaya; Jury A. Bocharov, Moscow; Vasily Y. Golovin, Voronezh; Alexandr T. Kruk, Voronezh; Ivan F. Yakovenko, Voronezh; Vladimir V. Novikov, Voronezh; Andrei M. Grishkov, Moscow; Valery N. Gorozhankin, Voronezh; Jury N. Sergeev; Vladimir E. Svistunov, both of Moscow, all of U.S.S.R.

[73] Assignees: Zavod-Vtuz Pri Moskovskom Avtomobilnom Zavode Imeni I.A. Likhacheva; Moskovskoe Vysshee Tekhnicheskoe Uchilische Imeni N. E. Baumana, both of Moscow, U.S.S.R.

[21] Appl. No.: 507,078

[22] Filed: Jun. 23, 1983

[51] Int. Cl.[4] ..... B21J 9/18

[52] U.S. Cl. ..... 72/454; 72/453.03

[58] Field of Search ..... 72/454, 112, 115, 453.02, 72/534.04, 453.03, 456; 100/282

[56] References Cited

FOREIGN PATENT DOCUMENTS 706173 1/1980 U.S.S.R. ..... 72/454

*Primary Examiner*—Daniel C. Crane
*Assistant Examiner*—David B. Jones
*Attorney, Agent, or Firm*—Fleit, Jacobson, Cohn & Price

[57] ABSTRACT

A press comprises a frame made up of two crossheads rigidly interconnected by way of uprights with two rams mounted therebetween one above the other. One of the rams has a built-in nut with a non-self-stopping thread to be thereby engaged with a screw rigidly connected to a die holder mounted for rotation in the other ram and geared to a drive for its translatory motion. Forced interaction between the nut and the screw is effected through a drive provided to actuate the ram with the nut and controlled from the drive of the die holder. There is provided a clearance of sufficient size between the rams to permit a specified angle of rotation of the die holder.

7 Claims, 24 Drawing Figures

PRESS

BACKGROUND OF THE INVENTION

1. Field of the Invention

The present invention relates to plastic working of metals and more in particular to presses.

The press of the invention is preferably used for forging round-shaped items such as wheels, discs, flanges, tapered and spherical funnels, etc.

These types of presses are especially effective for press forming of thin-walled forgings having relatively large outer diameter to thickness ratio (with D/H being over 7).

The press of the invention is suitable for the production of forgings from ferrous and nonferrous metals by hot, semi-hot or cold die forging.

2. Description of the Prior Art

Widely known in the art are hydraulic presses in which a working tool or a die is mounted for reciprocation. In the course of operation an appreciable friction force is created at such presses between the metal being forged and the die to prevent radial flow of metal. The thinner the forging, the greater is the friction force. Thus, relatively large forces, two- to ten-fold greater than those produced during friction-free forging, are required to overcome the friction force in question. With an increase in the D/H ratio from 1 to 6, the upset force is increased approximately twice as much, and with D/H equalling 30 it increases six times. Therefore, the working of small-size forgings requires presses capable of relatively large forces and having relatively great weight and dimensions which, in turn, necessitates much floor space. In the course of forging of small-size workpieces, relatively high loads are brought about to adversely affect the wearability of dies. This in turn leads to frequent replacement of their parts with the resultant increase in the production cost of forgings and brings down the production output of the press.

Shown in FIG. 1 is a chart representing the change in the upset force at which forgings are reduced to relatively small sizes depending on the movement of the die. Plotted along the x-axis is the die movement ΔH from the moment of initial upsetting of the forging, and plotted along the y-axis is the upset force P. Curve 1 at this chart is given to show the change in the upset force during translatory motion of the working tool. As is seen from the chart, the upset force sharply increases with the decrease in the height of a forging.

There is known a hydraulic press which comprises a frame made up of two crossheads rigidly interconnected by means of uprights. Mounted in guides one above the other between the uprights are two rams. One of the rams has a built-in nut with a non-self-stopping thread for forced engagement with a screw carrying a die holder. The die holder is mounted for rotaion in the other ram. Translatory motion of the screw is enabled by connecting the latter to the movable link of a hydraulic cylinder brought in communication with a fluid source and positioned on one of the crossheads.

The ram with the built-in nut has projections formed over its periphery. Fixed on the frame within a certain distance from the projections (when in initial position) are stops against which the ram with the nut is thrust up with its projections to permit forced engagement of the nut with the screw (cf. USSR Inventor's Certificate No. 706,173).

In the above-described press, the die holder with the die is capable of performing in the process of forging not only translatory motion, but rotary motion as well. The press of this type is intended for combined forging and twisting operations, during which the conditions of the contact friction between the workpiece and the die are due to change, with tangentially acting shear strain taking place in the metal under deformation. Such deformation of metal may lead to a multiple decrease in the working force and loads acting on the die, and to more uniform filling of the die impression with metal.

When external loads are applied to the workpiece under deformation normally or tangentially thereto, the process of deformation is sharply intensified. This, in all likelihood, is associated with the rotation of the friction vector and with the resultant decrease in the radial component thereof. In addition, a shear strain is produced under the action of tangential component of the friction vector. As a result, a required deforming force is reduced 2 to 10 times depending on the size ratio (or diameter to thickness ratio, indicated as D/H) in the workpieces, whereby a possibility is offered to produce round-shaped forgings with thin walls and bottom. Rotation of the working tool permits uniform filling of the die impression with metal and facilitates its operation during final forging. By reducing the influence of the contact forces of friction it becomes feasible to minimize the adverse effect of the eccentricity in the positioning of the workpiece relative to the die axis, resultant from the nonuniform filling of the die cavity with metal. This can be seen from the height of the flash formed at the butt end of the workpiece, as well as from the width of the flash formed over the entire perimeter of the forging. A decrease in the size of flash, as well as in the thickness of sections for broaching, makes it possible to enhance the metal utilization factor.

A decline in the intensity of the action force, as well as in other effects involved in the die forging and twisting, is direclty associated with the diameter to thickness ratio of each forging. FIG. 1 shows curves representing the change in the upset force under the action of a rotating tool (Curves 2, 3 and 4) at different working tool angular to translatory velocity ratio, with curve 4 being obtained at a higher ratio than for curve 2.

The prior-art press permits the die forging to be combined with twisting in the event when the ram with the built-in nut is brought to a stop. This is made possible when the projections of the ram with a built-in nut reach the stops on the frame. The angle of rotation of the die holder is determined from the following formula $$\phi = 2\pi \frac{\Delta H}{S},$$

where

ΔH is the value indicating translatory motion of the die holder when the ram with a built-in nut is brought to a stop;

S is the feed of the screw.

In the known hydraulic press the angle $\phi$ of rotation of the die holder during its translatory motion ΔH is relatively small. This can be explained by the fact that in the given press construction use is made of a non-self-stopping thread with an appreciable lead. Since small torsion angles make it impossible to substantially reduce the force of forging, the production range of the press is confined along with the type and size of forgings being produced.

In the known hydraulic press a relatively great force $P_1$, brought about by the pressure of the working fluid, acts on the movable link or plunger of a hydraulic cylinder, and on the frame. The force $P_1$ is to overcome resistance $P_2$ of the metal being deformed to the translatory motion of the die holder, as well as a force $P_3$ of the axial movement of the screw relative to the nut, which is brought about by the retarding action of torque M, hence:

$$P_1 = P_2 + P_3$$

From the above it follows that the rated force $P_1$ of the press is greater than the force $P_2$ of the axial motion of the die holder by a value of the force $P_3$ equal to: $P_3 = 2\pi M/S$. At relatively great torque M, the value of $P_3$ will be relatively high to result in the increase of the rated force of the press and in a greater amount of metal required for its manufacture.

It is therefore an object of the present invention to expand the production range of the press or, in other words, to produce forgings with a diameter to thickness ratio substantially greater than that in the known press of the same rated force.

Another object of the invention is to reduce the amount of metal normally required for the manufacture of the prior-art press used for producing forgings of similar type and size.

Still another object of the invention is to reduce the floor space required for the press.

These and other objects of the present invention are accomplished by the provision of a press comprising a frame made up of two cross heads rigidly interconnected by means of uprights with two rams mounted therebetween one above the other and of which one is fitted with a nut having a non-self-stopping thread forcibly engaged with a screw rigidly connected with a die holder mounted for rotation in the outer ram and geared to a drive for its translatory motion, wherein, forced engagement of the nut with the screw is effected through the agency of a drive provided to actuate the ram with the built-in nut and controlled from the drive of the die holder, with a clearance of sufficient size being provided between the rams to permit a specified angle of rotation of the die holder.

If a hydraulic cylinder communicating through a pressure line with a fluid source is used as the drive for the translatory motion of the other ram, the ram with a built-in nut is preferably actuated by means of at least one auxiliary hydraulic cylinder brought in communication with a fluid source through a pressure line and connected by its movable link to this ram.

This permits a hydraulically operated press to be used for die forging of workpieces by a rotating tool, while the hydraulic press in communication with a fluid source ensures the required translatory motion of the nut relative to the screw and, consequently, a specified angle of rotation of the die holder. In this way it becomes possible to achieve optimal parameters of forging or, in other words, to bring down the axial force of forging to a specified level.

In addition, it becomes possible to prevent rotation of the movable links or rods of hydraulic cylinders, and thereby to increase service life of their sealings.

Two auxiliary hydraulic cylinders are preferably provided to actuate the ram with the built-in nut, which cylinders are arranged in symmetry with the hydraulic cylinder for translatory motion of the die holder on one and the same crosshead.

Such structural arrangement permits all hydraulic cylinders to be arranged on one crosshead and facilitates assembly and servicing of the press.

It is preferred to have a fluid pressure gauge set in the pressure line communicating the hydraulic cylinder for actuating the die holder with a fluid source while a pressure line communicating at least one auxiliary hydraulic cylinder with a fluid source is preferably furnished with a variable orifice and a pressure valve responsive to a signal from the pressure gauge.

Providing the pressure gauge for controlling the operation of the auxiliary hydraulic actuators would enable rotation of the die holder at a given force to forge, when it is essential to set in rotation the working tool. It has been found from an analysis of the curve 1 shown in FIG. 1 that the greatest force to forge is produced at the end of forging. Hence, the die forging and twisting could be recommended for use precisely at this moment of deformation. Such mode of die forging permits the working stroke of the ram with the built-in nut to be utilized most efficiently and power losses due to twisting to be reduced. The provision of a variable orifice makes it possible to control the speed of rotation of the die holder, which further enhances efficiency of the working stroke of the ram with the built-in nut.

Advantageously, the pressure line communicating the hydraulic cylinder for translatory motion of the die holder is made to pass through at least one auxiliary hydraulic cylinder wherefor the rod end of the latter is brought in communication with the head end of the hydraulic cylinder, with the ratio of the cross-sectional area of the head end of the hydraulic cylinder to the cross-sectional area of the rod end of at least one auxiliary hydraulic cylinder being equal the ram with a built-in nut to die holder speed ratio.

This press construction allows for such mode of forging that would permit the die holder angular to translatory speed ratio to be maintained constant over the entire period of forging. In addition, owing to the boosting effect it is possible to create a higher pressure in the head end of the hydraulic cylinder for translatory motion of the die holder than in the fluid source, whereby it becomes feasible to reduce dimensions of both the hydraulic cylinder and press as a whole.

The press is preferably provided with one auxiliary hydraulic cylinder adapted to actuate the ram with a built-in nut and mounted on a common crosshead coaxially with the hydraulic cylinder provided to enable translatory motion of the die holder and positioned on the crosshead, with a supporting bearing being set between the ram and the die holder.

Such structural arrangement makes it possible to reduce the frame in height and width, to unload the frame, and thus to bring down the amount of metal required for its manufacture.

Both rams are preferably interconnected and a clearance of sufficient size permitting a specified angle of rotation of the die holder is formed between the opposite ends of the nut and the die holder.

Such a structural arrangement is effective where it is necessary to obtain relatively small torsion angles and, consequently, to move the ram with a built-in nut relative to the die holder. As a result it becomes feasible to reduce dimensions of the press and simplify its construction. Such press construction is advantageously used for die forging of workpieces in three stages, namely: upsetting of the workpiece, its die forging and cutting off flash or fins. The forging operation is preferably combined with twisting, while two other operations are carried out with the aid of an advancing tool fixed by auxiliary die holders on the ram in symmetry with the rotating die holder.

With the rams made into a single unit, the press construction is rendered space-saving and permits the die holders for auxiliary dies to be mounted on the ram.

Where the drive provided to enable translatory motion of the die holder comprises, arranged on one of the crossheads and connected to an electric motor, a shaft with an eccentric coupled through a connecting rod to a screw carrying a die holder, the drive of the ram with a built-in nut is preferably provided with two connecting rods arranged in symmetry with the connecting rod coupled to the nut, and connected with the ram and geared to the shaft.

Thus a crank press may be suitably used for die forging by means of a rotating tool and the drive of the ram with a built-in nut permits a required translatory motion of the nut relative to the screw, whereby a specified angle of rotation of the die holder is obtained to produce a forging of a preset size. In this way it becomes possible to secure optimal parameters of forging by reducing its axial force $P_2$.

The gearing of the shaft with the connecting rods, coupled to the ram with a built-in nut, is preferably effected through the agency of two eccentrics positioned on the shaft in symmetry with the eccentric and turned relative thereto in the direction opposite to the direction of rotation of the shaft through an angle sufficient to permit a specified angle of rotation of the die holder.

Such structural arrangement permits the simplest type of gearing of the shaft with the connecting rods coupled to the ram. With two eccentrics being turned relative to the central shaft in the direction opposite to the direction of its rotation, the gearing of the press is such that permits the die holder angular to translatory speed ratio to be sharply increased toward the end of forging with the resultant decrease in the force to forge and more uniform filling of the die impression with metal.

The gearing of the shaft to the connecting rods, coupled to the ram with a built-in nut is preferably effected through an auxiliary shaft mounted on the other crosshead of the frame and provided with two eccentrics connected with the ram coupled to an auxiliary electric motor and through a train of gears with a shaft, with the angle in the direction of rotation of the shaft between the axes of the press and the eccentric of the shaft being greater than the angle between the axes of the press and the eccentrics of the auxiliary shaft by a value sufficient to permit a specified angle of rotation of the die holder.

Such a structural arrangement makes it possible to reduce the press in width by reducing the length of the press. At the same time, rigidity of the press may be increased and the load acting thereon decreased by reason of the fact that the effort required to rotate the die holder is transmitted through an auxiliary shaft. This also reduces the torque transmitted from the drive to the shaft, which facilitates its operation.

The gearing of the shaft to the connecting rods, coupled to the ram with a built-in nut, is preferably effected through the agency of the connecting rod linked with a screw wherefor a pin is mounted therein away from the longitudinal axis of the connecting rod at a distance sufficient to permit a specified angle of rotation of the die holder, which pin is coupled to the connecting rods linked with the ram.

Such a structural arrangement makes it possible to use the shaft with a single eccentric, which simplifies construction of the press and contributes to its high rigidity.

The gearing of the shaft to the connecting rods coupled to the ram with a built-in nut, is preferably effected by means of two rockers arranged in symmetry with the eccentric cooperating with the connecting rod coupled to the screw to enable its translatory motion, each of the rockers having one of its arms coupled to the connecting rods and the other arm through at least one intermediate link to the connecting rod joined with the screw away from the axis of the eccentric at a distance sufficient to permit a specified angle of rotation of the die holder.

Such a structural arrangement substantially improves the gearing of the press and thus provides for the most effective movement of the ram with a built-in nut as well as rotation of the die holder to enable optimal process parameters.

BRIEF DESCRIPTION OF THE DRAWINGS

The invention will be now described, by way of example only, with reference to the accompanying drawings, wherein.

DETAILED DESCRIPTION OF THE PREFERRED EMBODIMENTS

Figure 1:
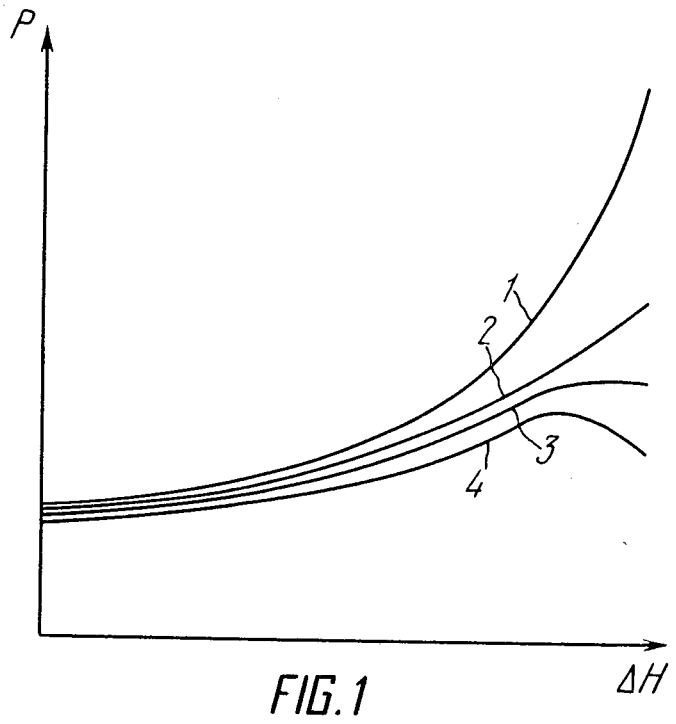
FIG. 1 depicts a chart representing the change in the upset force depending on the amount of movement of the die holder.

Referring now to the above drawings, and to FIG. 2 in particular, a hydraulically operated press, which is hereinafter referred to as hydraulic press, comprises a frame formed by an upper crosshead 1 and a lower crosshead 2 interconnected by means of uprights 3. The uprights 3 have guides 4 with a top ram 5 and a bottom ram 6 mounted therein so that a clearance "a" is formed therebetween at the beginning of the forging operation. The top ram 5 has a built-in nut 7 with a non-self-stopping thread. Mounted for rotation in the bottom ram 6 is a die holder 8 carrying a die "C".

The die holder 8 is rigidly connected with a screw 9 which forms a kinematic pair together with the nut 7. By means of an articulation 10, permitting rotation of the screw 9, the latter is connected to a rod 11 of a hydraulic cylinder 12 mounted on the upper crosshead 1. The head end of the hydraulic cylinder 12 is brought in communication through a pressure line 13 with a fluid source 14, which may be a pump house prividing for the delivery of a high-pressure fluid to the hydraulic cylinder 12, and a filling system provided to deliver a low-pressure fluid to the hydraulic cylinder 12. The hydraulic cylinder 12 is used to ensure translatory motion of the ram 6 with the die holder 8.

To enable forced interaction of the nut 7 with the screw 9, the ram 5 with the built-in nut 7 is provided with an independent actuator in the form of two auxiliary hydraulic cylinders 15 mounted on the upper crosshead 1 symmetrically with the hydraulic cylinder 12. The head ends of the hydraulic cylinders 15 are brought in communication with the fluid source 14 through a pressure line 16. Movable links or rods 17 of the hydraulic cylinders 15 are connected to the ram 5.

The hydraulic cylinders 15 are brought in operation in response to a signal from a liquid pressure gauge 18 built into a pressure line 13. Set in the pressure line 16, communicating the hydraulic cylinder 15 with the fluid source 14, are a variable orifice 19 and a pressure valve 20 responsive to a signal from the pressure gauge 18. Though the pressure gauge 18 used in the preferred embodiment is an electrical manometer, any other conventional type of sensor means, such as pressure relay, may be used for the same purpose.

The rod ends of the hydraulic cylinders 12 and 15 are brought in communication with a low-pressure fluid source (not shown).

Figure 3:
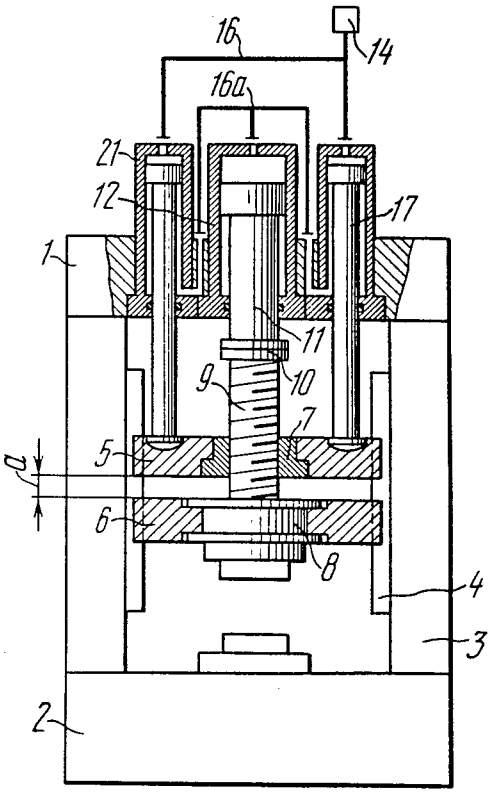
FIG. 3 is a view of a hydraulically operated press in which the rod ends of auxiliary cylinders are brought in communication with the head end of a main hydraulic cylinder.

Shown in FIG. 3 is a hydraulic press similar to that described above. In this press the head ends of two auxiliary cylinders 21 are brought in communication with the fluid source 14 through the pressure line 16, while their rod ends communicate via the pressure line 16*a* with the head end of the hydraulic cylinder 12. This being the case, the ratio of the cross-sectional area of the head end of the hydraulic cylinder 12 to the aggregate cross-sectional areas of the rod ends of the hydraulic cylinders 21 equals the ratio of the travelling speed of the ram 5 to that of the die holder 8. Owing to this factor it becomes possible to maintain constant relation between the travelling speeds of the top ram 5 and the bottom ram 6, which determines the field of application of the presses thus constructed. In particular, these types of presses may be suitably used in forging combined with a twisting operation, the optimal conditions for which are ensured by a constant ratio of the angular to translatory velocity of the die holder, as well as in the production of long-size forgings, the material of which require thorough working.

Figure 4:
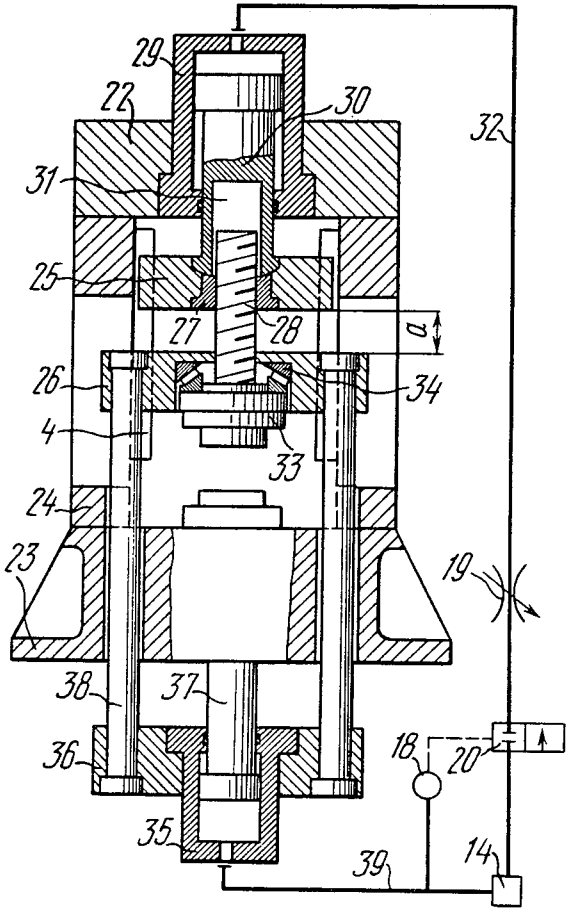
FIG. 4 is a view of a hydraulically operated press in which the main hydraulic cylinder and the auxiliary one are arranged coaxially with one another.

FIG. 4 shows a hydraulic press the frame of which is formed with an upper crosshead 22 and a lower crosshead 23 interconnected by means of uprights 24. Mounted in the guides 4 between the uprights 24 are rams 25 and 26. The ram 25 has a built-in nut 27 with a non-self-stopping thread for engagement with a screw 28, thereby forming a kinematic pair. Mounted on the crosshead 22 is an auxiliary hydraulic cylinder 29 which serves as an independent actuator of the ram 25 while a rod 30 of the former acts on the latter.

The rod 30 has a cavity 31 opened from the bottom to receive the screw 28. The hydraulic cylinder 29 is brought in communication with the fluid source 14 through a pressure line 32 provided with the variable orifice 19 and the pressure valve 20.

The bottom ram 26 accommodates a die holder 33 mounted therein for rotation. The die holder 33 is rigidly connected with the screw 28. Mounted between the die holder 33 and the ram 26 is a supporting bearing 34.

Translatory motion of the die holder 33 is effected by means of a drive in the form of a hydraulic cylinder 35 arranged coaxially with the hydraulic cylinder 29 in a traverse 36. The hydraulic cylinder 35 has its rod 37 rigidly connected to the crosshead 23 and its body, also shown at 35 and serving as a movable link thereof, is connected to the traverse 36 tied up by tie rods 38 with the ram 26. Thus, the ram 26, traverse 36 and tie rods 38 form a rigid frame. The hydraulic cylinder 35 is brought in communication with the fluid source 14 through a pressure line 39 provided with the fluid pressure gauge 18 set therein to send a signal on response to which the pressure valve 20 and, consequently, the hydraulic cylinder 29 are operated.

Coaxial arrangement of the hydraulic cylinders 29 and 35 makes it possible to reduce the press in width and permits the frame to be loaded only under the action of the hydraulic cylinder 29, which brings down the amount of metal required for the manufacture of the press frame. By providing the rod 30 of the hydraulic cylinder 29 with the cavity 31 it becomes possible to reduce the frame in height. The press construction is advantageous also in that it precludes rotation of the movable members of the hydraulic cylinders 29 and 35, which improves reliability of their sealings.

Figure 5:
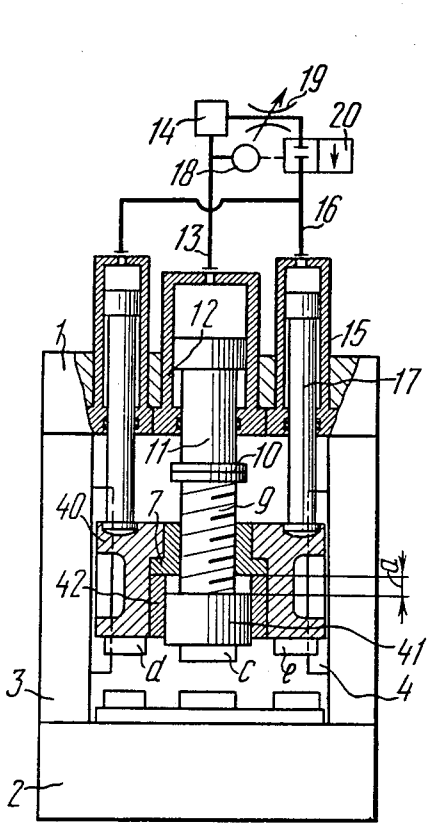
FIG. 5 is a view of a hydraulically operated press in which the rams are rigidly interconnected with one another.

Shown in FIG. 5 is another embodiment of the hydraulic press in which the rams are rigidly interconnected, while in the preferred embodiment they are made into a single unit in the form of a ram 40. Fitted in the upper part of this ram is the nut 7 brought in engagement with the screw 9 connected with a die holder 41. Provided in the lower part of the ram 40 are guides 42 for the die holder 41. Formed between the opposite butt ends of the nut 7 and the die holder 41 is a clearance "a" of a size sufficient to permit a specified of rotation of the die holder 41. In all other aspects the press construction is similar to that shown in FIG. 2 and as described above.

Such press construction makes it possible to reduce overall dimensions of the press by making its ram assembly of small bulk. A single-unit ram is allowed a good guidance in the frame and is fit to carry on its lower end an auxiliary tool or a die "d" and "e", which makes for effective utilization of a three-impression forging in the given press.

The press according to another embodiment of the invention is provided with a crank drive and therefore will be hereinafter referred to as a crank press. The press in question comprises a frame formed by two crossheads of which a top crosshead is shown at 43 and a bottom crosshead at 44 in FIG. 6. The top and bottom crossheads 43 and 44 are interconnected by means of uprights 45. The uprights 45 are provided with guides 46 for a ram 47 with a built-in nut 48, having a non-self-stopping thread, to be mounted therein. The nut 47 is brought into threaded engagement with a screw 49 thereby to form a kinematic pair. Fixed on the lower end of the screw 49 is die holder 50, which is mounted for rotation in the ram 47. Formed between the opposite butt ends of the nut 48 and the die holder 50 is a clearance "a" of a size sufficient to permit a specified angle of rotation of the die holder 50. This clearance is formed prior to deformation of the workpiece (not shown). By means of a collar bearing, the upper end of the screw 49 is coupled to a crank 51, which is hereinafter referred to as a central crank and which forms a rotating couple together with an eccentric 52 fitted on a shaft 53 geared to the shaft of an electric motor (not shown).

The shaft 53 is mounted on the top crosshead 43 and has two eccentrics 54 arranged symmetrically with the eccentric 52, and turned relative thereto in the direction opposite to the direction of rotation of the shaft 53 through an angle $\alpha_1$ (FIG. 7) sufficient to obtain a preset angle of rotation of the die holder 50.

The ram 47 is connected to the ends of the connecting rods 55, which will be further referred to as lateral connecting rods and which are arranged symmetrically with the connecting rod 51 to be hereinafter referred to as a central connecting rod; the other ends of the connecting rods 55 are coupled to the eccentrics 54, thereby forming rotating pairs.

Overhung on the shaft 53 are a brake 56 and a clutch 57 by means of which the shaft 53 is geared to a drive including an electric motor (not shown).

Figure 7:
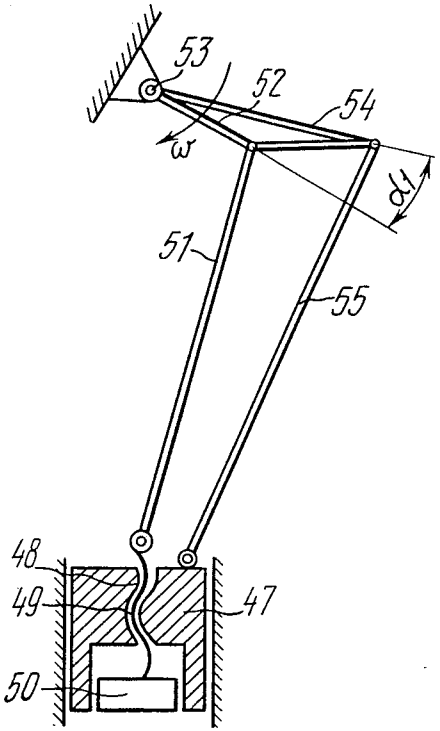
FIG. 7 shows the gearing of the press depicted in FIG. 6.
Figure 6:
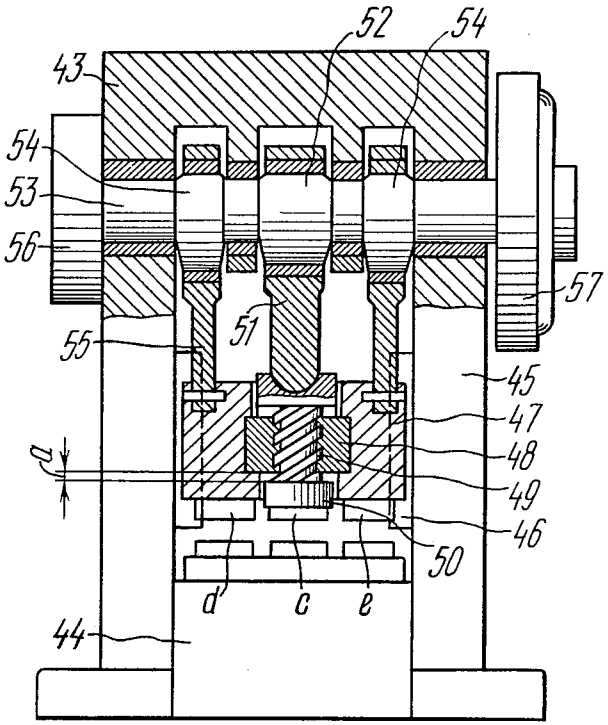
FIG. 6 is a view of a press with a crank drive according to the invention wherein the shaft comprises two eccentrics coupled to the connecting rods in connection with the ram having a built-in nut.

Shown in FIG. 7 is a mechanical diagram of the hydraulic press depicted in FIG. 6; the eccentrics 52 and 54 are shown in this figure as cranks 52 and 54 rotating at an angular velocity "W" together with the shaft 53 in the direction indicated by arrow. The eccentrics 54 are offset relative to the eccentric 52 in the direction opposite to the direction of rotation of the shaft 53 by an angle $\alpha_1$ sufficient to permit a preset angle of rotation of the die holder 50.

In the described construction of the crank shaft there is provided the simplest type of gearing between the lateral cranks 55 and the shaft 53. Such gearing provides for the most intensive rotation of the die holder 50 and, consequently, for the greatest reduction in the amount of action force to take place at the final stage of forging, with the resultant improvement in the filling of the die impression with metal.

Figure 8:
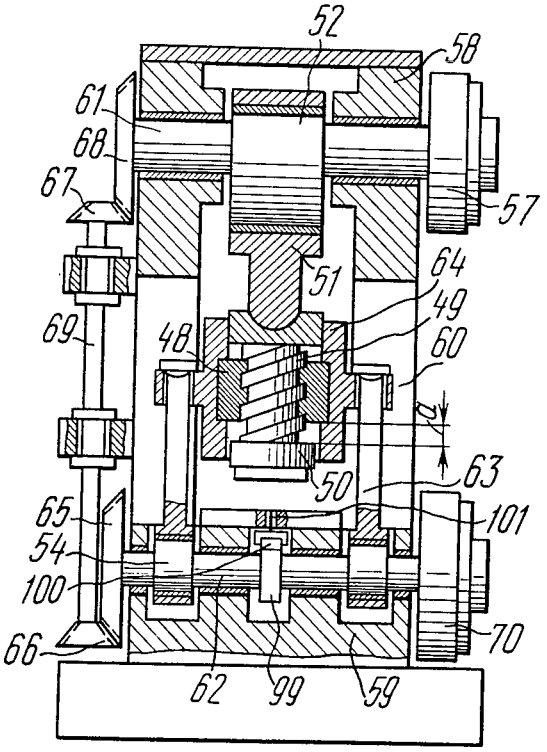
FIG. 8 is a view of a press with a crank drive, wherein the auxiliary shaft with two eccentrics is mounted in the other crosshead.

Shown in FIG. 8 is another embodiment of a crank press which comprises a frame formed by a top crosshead 58 and a bottom crosshead 59 interconnected by means of uprights 60. Mounted on the top crosshead 58 is a shaft 61, which is hereinafter referred to as a main shaft and which is provided with the eccentric 52 forming a rotating pair with the central crank 51. Mounted on the bottom crosshead 59 is an additional shaft 62 having two eccentrics 54 forming rotating pairs with connecting rods 63 linked to the main shaft 61 with a ram 64. The additional shaft 62 is geared through gear wheels 65, 66 and 67 as well as through a shaft 69. In addition, the additional shaft 62 is coupled to an electric motor (not shown) by means of a clutch 70.

Figure 9:
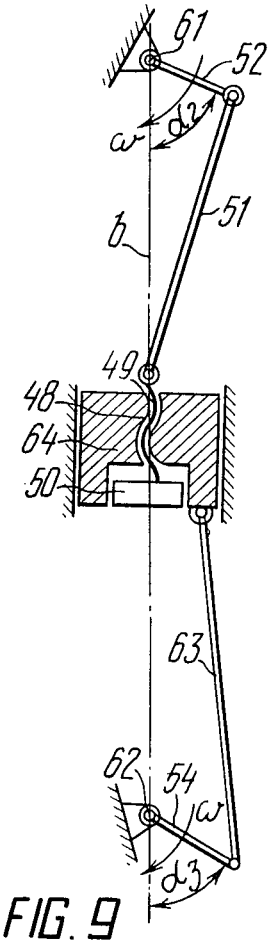
FIG. 9 shows the gearing of the press depicted in FIG. 8.

FIG. 9 illustrates a mechanical diagram of the crank press shown in FIG. 8. The eccentrics 52 and 54 are shown in FIG. 8 as cranks 52 and 54, rotating together with the shafts 61 and 62, respectively, at an angular velocity "W". The crank 52 forms with the geometric axis "b" an angle $\alpha_2$, and the crank 54 forms an angle $\alpha_3$. The angle $\alpha_3$ is greater than the angle $\alpha_2$ by the angle $\alpha_1$ ($\alpha_3-\alpha_2=\alpha_1$); the angle $\alpha_1$ should be sufficient to permit a preset angle of rotation of the die holder 50.

Such design feature allows the main shaft to be arranged in the described crank press in a manner similar to that widely practiced in crank hot-forging presses which have relatively high rigidity and which ensure relatively high accuracy of forging. By providing the press with two shafts 61 and 62 (main and additional), it becomes possible to reduce the press in width as compared to the single-shaft press shown in FIG. 6. In addition, the main shaft 61 is unloaded at the expense of the additional shaft 62, which is provided with a drive of its own.

Figure 10:
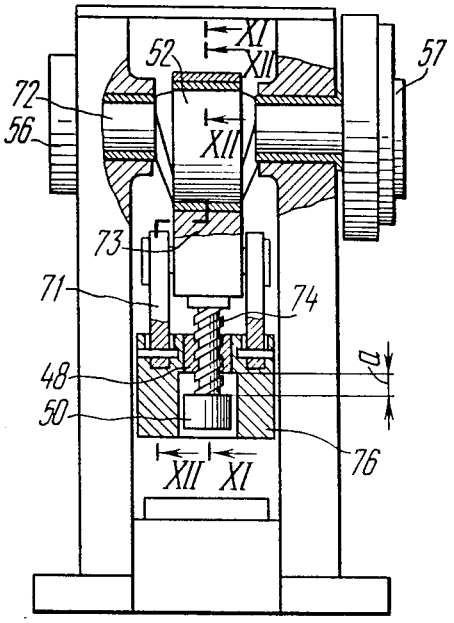
FIG. 10 is a view of a press with a crank drive, wherein the lateral connecting rods are linked with the connecting rod tied up with a screw.

FIG. 10 shows a crank press with a gearing different from that incorporated in other presses described above. In this press lateral connecting rods 31 are coupled to a shaft 72. The shaft 72 is provided with a single eccentric, which is also shown at 52 and which forms a rotating pair with a central connecting rod 73 linked to a screw 74 carrying the die holder 50. Fixed on the connecting rod 73 is an axle 75 (FIGS. 11 and 12) by means of which the central connecting rod 73 is joined with the lateral connecting rod 71, which are coupled to the ram 76 having a built-in nut shown at 48 in FIG. 10.

Figure 11:
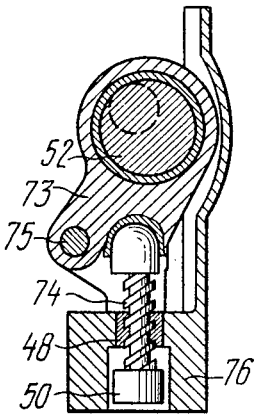
FIG. 11 is a cross-section on line XI—XI of FIG. 10.
Figure 12:
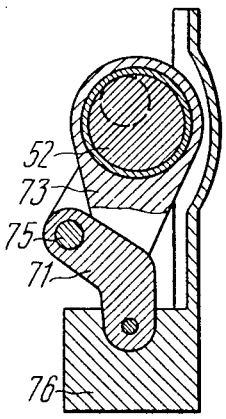
FIG. 12 is a cross-section on line XII—XII of FIG. 10.
Figure 13:
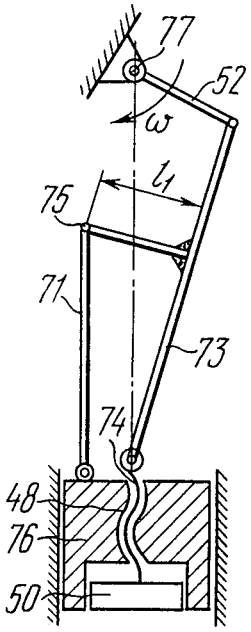
FIG. 13 shows the gearing of the press depicted in FIG. 10.

FIG. 13 shows a mechanical diagram of the press illustrated in FIGS. 10, 11 and 12. The connecting rod 73 is shown in FIG. 13 in the form of a rod with an extension of a length "$l_1$" articulated to the lateral connecting rods 71. The distance "$l_1$", as measured from the geometric axis of the connecting rod 73 to the axle 75, should be sufficient to permit a preset angle of rotation for the die holder 50.

The mechanical diagram described above makes it possible to simplify construction of the press while maintaining relatively high rigidity thereof.

Figure 14:
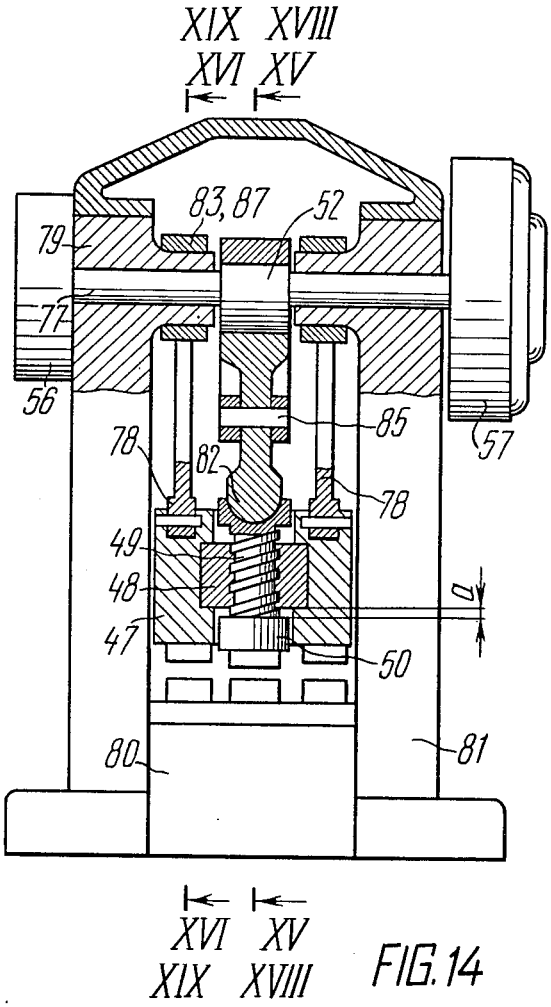
FIG. 14 is a press with a crank drive, wherein the lateral connecting rods are coupled to the shaft by means of ladder-type mechanisms.

Referring now to FIG. 14, there is shown a crank press in which a shaft 77 is geared to lateral connecting rods 78 by means of a ladder-type mechanism. The press comprises a top crosshead 79 and a bottom crosshead 80 interconnected by means of uprights 81. Mounted on the top crosshead 79 is a shaft 77 with an eccentric 52 forming a rotating pair with a central connecting rod 82 (FIG. 15) coupled to the screw 49 carrying the die holder 50.

Figure 17:
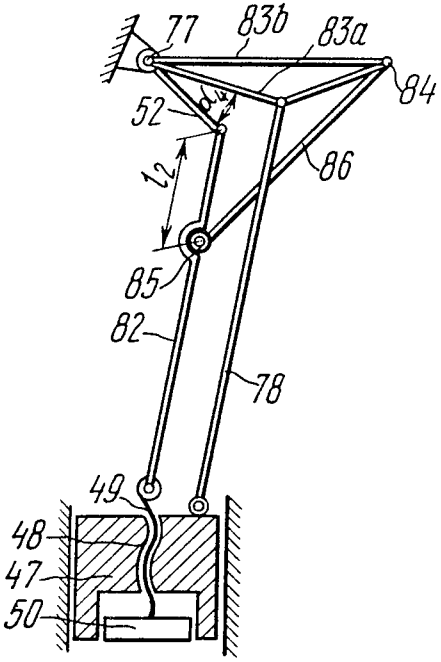
FIG. 17 shows the gearing of the press depicted in FIGS. 14, 15 and 16.
Figure 15:
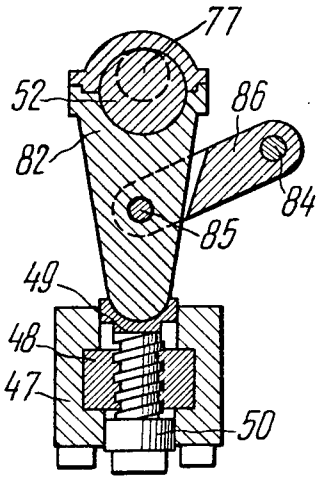
FIG. 15 is a cross-section on line XV—XV of FIG. 14.

Mounted on the crosshead 79 in coaxial arrangement with the shaft 77 are two rockers 83 (FIG. 16) which are arranged symmetrically with the eccentrics 52 (FIG. 15). Each of the rockers 83 (FIG. 16) has its one arm 83*a* (FIG. 17) linked to the corresponding lateral connecting rod 78 while other arms 83*b* (FIG. 17) of the rockers 83 are interconnected by means of a pin 84.

Figure 16:
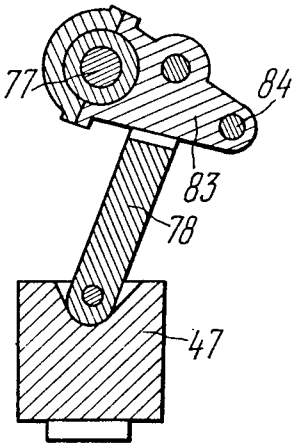
FIG. 16 is a cross-section on line XVI—XVI of FIG. 14.

The central connecting rod 82 (FIG. 15) is connected by means of a pin 85 with an intermediate link 86 connected to the pin 84 on which are pivoted the rockers 83 (FIG. 16). The pin 85 (FIG. 15) is positioned on the central connecting rod 82 and spaced from the axis of the eccentric 52 (FIG. 17) by a distance "$l_2$".

The angle of rotation of the die holder 50 depends on the distance "$l_2$", on the length of the arm 83*a* of the rocker 83, as well as on the angle $\alpha_4$ between the eccentric 52 and the arm 83*a* of the rocker 83. These parameters are selected so as to permit a preset angle of rotation of the die holder 50.

Though the gearing of the lateral connecting rods 78 with the shaft 77 is more complicated in the above-described crank press than in the crank presses shown in FIGS. 6 to 13, it allows for such relation between the rotary and translatory motions of the die holder 50 that makes it possible to improve the forging process.

In the construction of the press shown in FIGS. 14, 18, 19 and 20, mechanical linkage of the lateral connecting rods 78 (FIG. 14) with the shaft 77 (FIG. 18) is effected by means of two rockers 87 (FIG. 19), each having two arms 87*a* and 87*b* (FIG. 20) mounted on the crosshead 79 (FIG. 14) in symmetrical arrangement with the eccentric 52.

The arms 87*a* (FIG. 20) of the rockers 87 are pivotally connected to the corresponding lateral connecting rods 78, while the arms 87*b* of the rockers 87 are pivotally connected through intermediate links 88 to an arm 89*a* of the rocker 89, which also serves as an intermediate link and which is pivoted on a pin 90 rigidly fixed on the frame of the press. Another arm 89*b* of the rocker 89 is connected through an intermediate link 91 to the central connecting rod 82. This connection is effected through the agency of a pin 85 disposed along the geometric axis of the connecting rod 82 at a distance $l_3$ from the axis of the eccentric 52.

The rocker 89 is connected to the intermediate links 88 and 91, and the rockers 87 are connected to the intermediate links 88 and connecting rods 78 by means of pins 92.

The angle of rotation of the die holder 50 in this construction of the crank press depends on the same parameters as mentioned in the description of the crank press shown in FIGS. 14, 15, 16 and 17, as well as on the length of the arms 89*a* and 89*b* of the rocker 89. This provides for better relation between the rotary and translatory motions of the die holder 50 as compared with the crank press shown in FIGS. 14, 15, 16 and 17, which makes it possible to improve the process of forging.

Referring now to the crank press shown in FIGS. 21, 22, 23 and 24, mechanical linkage of the lateral connecting rods 78 (FIG. 21) with the shaft 72 is effected substantially as described above. The distinction lies in that an intermediate link 93 (FIG. 22) is pivotally connected to a central connecting rod 94 through the agency of a pin 95 which is spaced apart from the geometric axis of the connecting rod 94 by a distance "$l_4$" sufficient to permit a preset angle of rotation of the die holder 50.

A rocker 96, also serving as the intermediate link, has its arms 96*a* and 96*b* (FIG. 24) connected to a rocker 97 (FIG. 23), having arms 97*a* and 97*b*, by means of intermediate links 98.

Figure 20:
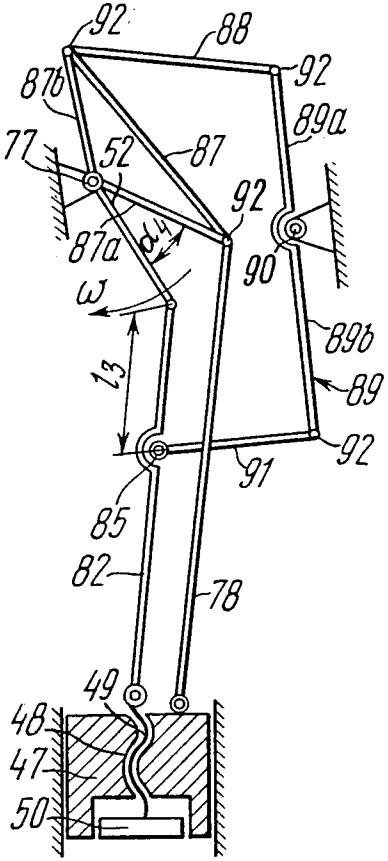
FIG. 20 is the gearing of the press depicted in FIGS. 14, 18 and 19.
Figure 19:
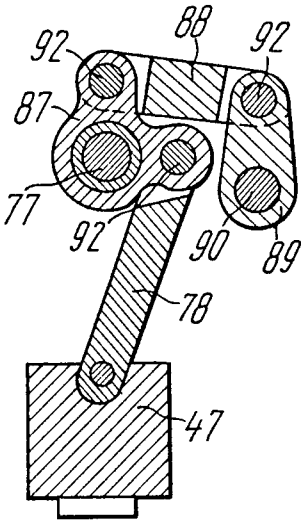
FIG. 19 is a cross-section on line XIX—XIX of FIG. 14.
Figure 18:
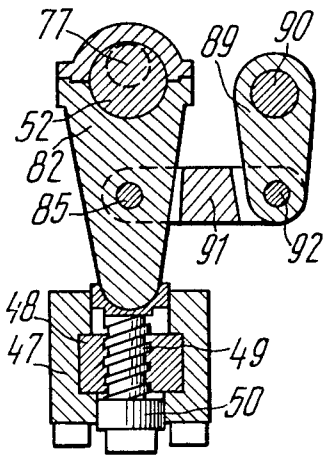
FIG. 18 is a cross-section on line XVIII—XVIII of FIG. 14.
Figure 21:
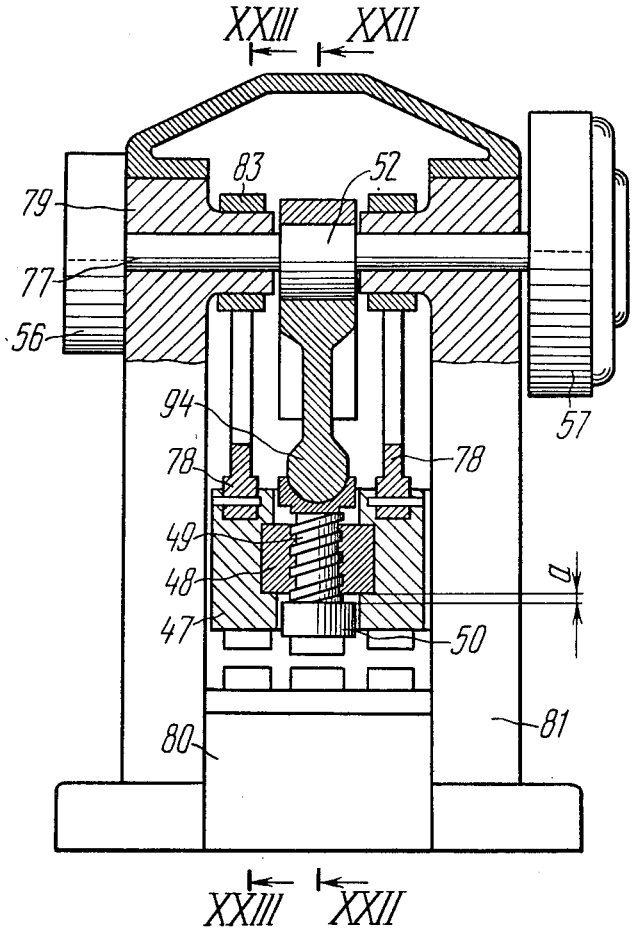
FIG. 21 is a view of a press with a crank drive, wherein the lateral connecting rods are coupled to the shaft by means of ladder-type mechanisms.
Figure 24:
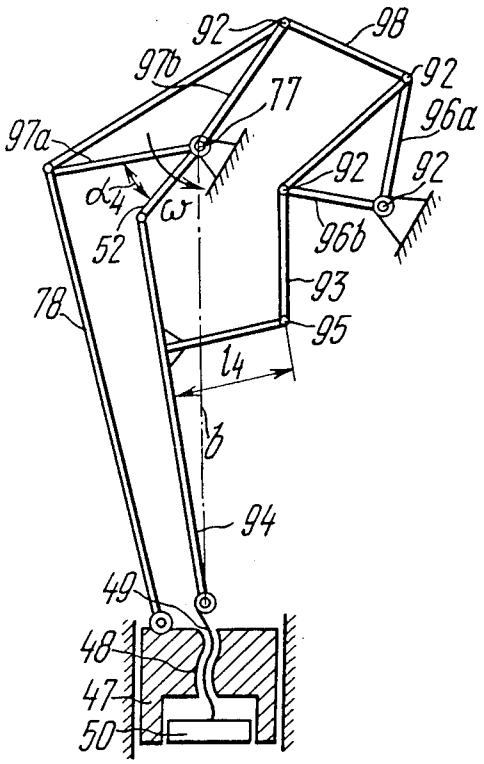
FIG. 24 shows the gearing of the press depicted in FIGS. 21, 22 and 23.
Figure 23:
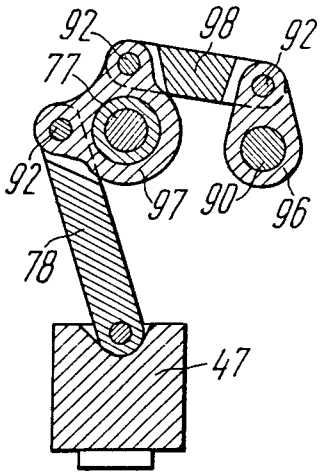
FIG. 23 is a cross-section on line XXII—XXII of FIG. 14.
Figure 22:
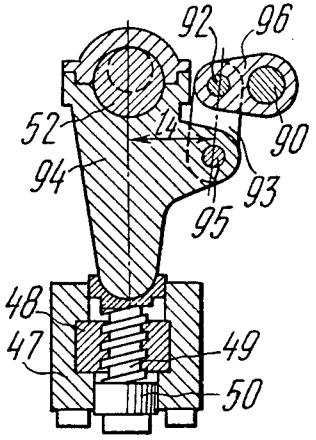
FIG. 22 is a cross-section on line XXI—XXI of FIG. 14.

Such construction makes it possible to reduce dimensions of the crank press described above and facilitates its repair and maintenance, as compared with the crank press shown in FIGS. 18, 19 and 20, due to the fact that the lateral connecting rods 78 and the arms 97*a* of the rockers 97, as well as the rocker 96 together with the intermediate links 98 and 93, are arranged on different sides of the geometric axis "b" (FIG. 24) of the crank press which improves its equilibrium in the process of operation and facilitates its repair and maintenance.

The press operates in the following manner.

Let us consider first the operation of hydraulic presses. Initially, the rams 5 and 6 occupy uppermost position, with a clearance "a" between them equalling zero. Once a workpiece is fed to be forged, the top die "C", fixed on the die holder 8, is brought in contact with the workpiece and the clearance "a" of a sufficient size is formed between the rams 5 and 6. To this end, a low-pressure fluid is delivered from the fluid source 14 along the pressure line 13 to the hydraulic cylinder 12, as a result of which the rod 11 starts its downward movement together with the screw 9, die holder 8 and ram 6 until the top die "C" is brought in contact with the workpiece. Next, a high-pressure fluid is delivered from the fluid source 14 along the pressure line 13 to the hydraulic cylinder 12. Under the action of the high-pressure fluid the screw 9 starts its downward movement together with the ram 6, thereby deforming the workpiece as it takes up the shape of the impression formed in the die "C". In the course of upsetting the forging strain increases until a predetermined value thereof is reached to set in operation the fluid pressure gauge 18 which sends a signal to open the pressure valve 20. Then, the high-pressure fluid is also delivered to the hydraulic cylinders 15. Under the action of high-pressure fluid the rods 17 of the hydraulic cylinders 15 start their downward movement together with the top ram 5 having the built-in nut 7. If velocity $V_1$ of the top ram is greater than velocity $V_2$ of the bottom ram 6, then the screw 9 starts rotating under the action of the nut 9 at an angular velocity of $$W = (V_1 - V_2)\frac{2\pi}{S}, \tag{1}$$

where

S is the feed of the screw 9.

The aggregate force $P_3$ of the hydraulic cylinders is calculated on account of a maximum permissible torque to be overcome thereby. This being the case, the forging is accompanied by twisting with the relationship between the angular and translatory velocities of the die holder 8 being expressed as $$\frac{W}{V_2} = \frac{2\pi}{S}\left(\frac{V_1}{V_2}\right) - 1\Big) \tag{2}$$

Rotation of the die holder 8 will cause slipping of the die working surface relative to the workpiece along with shear strain in the direction of rotation. This will improve radial flow of metal and lower resistance to the upset force of the workpiece. What is gained is a multiple reduction in the force to forge as compared to the similar force which comes into being during forging without twisting. A preset level of reduction in the force to forge is attained by an appropriate angle $\phi$ of rotation of the die holder 8, which depends on the distance "a" between the rams 5 and 6, as well as on the feed "S" of the screw 9, which is determined by the conditions of a non-self-stopping thread in accordance with the following formula:

$$\phi = a\frac{2\pi}{S} \tag{3}$$

The clearance "a" should be sufficient to permit the production of a forging, with the size of this clearance being varied in accordance with the size of a forging. In order to obtain the clearance "a" of a specified size it is necessary that definite relationship be maintained between the angular and translatory velocities (W and V) of the die holder 8 in the course of forging. Thus, the velocity $V_1$ of the ram 5 is preferably adjusted with the aid of the variable orifice 19 built into the pressure line 16.

The aggregate force $P_3$ of the hydraulic cylinders 15 is transmitted by means of the screw pair, formed by the nut 7 and screw 9, to the die holder 8 and then is added to the force $P_4$ of the hydraulic cylinder 12. The aggregate force $P_3+P_4$ overcomes resistance $P_2$ offered by the metal being deformed to the translatory of the die holder, that is:

$$P_2=P_3+P_4 \tag{4}$$

Thus the force $P_2$ is a rated force of the press. In other words, the load taken up by the frame of the press is not greater than the force $P_2$ to forge, while the force of each hydraulic cylinder 12 and 15 is lower than this force.

Once the impressions of the die "C" are filled up with metal, the rams 5 and 6 are stopped. The working fluid is delivered to the rod ends of the hydraulic cylinders 12 and 15, whereupon the rams 5 and 6 are returned to their initial position. This ends the operating cycle.

If the clearance "a" is insufficient to produce a forging, then the impression of the die will not be filled up with metal during intimate contact of the rams 5 and 6. As a result, the die undergoes the action of the rated force of the press, no twisting is produced, and the force to forge will be insufficient to cause deformation of metal. To ensure effective forging of the workpiece, the clearance "a" of sufficient size should be formed between the rams 5 and 6, and the forging cycle should be resumed. Thus a forging can be produced by the press of the invention in the course of two or three working strokes, this being a distinctive feature of the given press, making for its superiority over known presses in which the forging is produced during a single working stroke. Therefore, a good opportunity is offered to expand production potentialities of hydraulic presses.

It should be observed that optimal operating conditions in forging practice may be ensured by providing constant relation between the rotary and translatory velocities of the die holder 8. In this case the press construction should be as shown in FIG. 3. During the working stroke a high-pressure fluid is delivered from the fluid source 14 to the head ends of the hydraulic cylinders 21, thereby acting on the rods 17 of these cylinders. Under the action of pressure the ram 5 is set in motion and the fluid is forced out of the rod ends of the hydraulic cylinders 21 to pass into the head ends of the hydraulic cylinder 12. Thus pressure is increased in the hydraulic cylinder 12 to actuate the rod 11 along with the screw 9 and die holder 8. This pressure may be higher than that in the head end of the hydraulic cylinders 21 or in the fluid source 14, this being due to boosting effect. Owing to high pressure in the hydraulic cylinder 12 it becomes possible to reduce its dimensions.

If $V_1$, the travelling speed of the ram 5, is known, then the travelling velocity $V_2$ of the die holder 8 may be determined from the relationship:

$$V_1 \cdot F_1 = V_2 \cdot F_2, \tag{5}$$

where $F_1$ and $F_2$ are the cross-sectional areas equal to the sum total of the rod ends of the hydraulic cylinders 21 and the head end of the hydraulic cylinder 12.

Substituting $V_1/V_2=F_2/F_1$ in Eq. (2) gives $$\frac{W}{V_2} = \frac{2\pi}{S}\left(\frac{F_2}{F_1} - 1\right) \tag{6}$$

From the above it follows that the relation of the angular velocity W of the die holder 8 to its translatory velocity V is a constant value depending on the ratio of the cross-sectional area of the head end of the hydraulic cylinder 12 to the aggregate cross-sectional area of the rod ends of the hydraulic cylinders 21 connected to the ram 5 with the built-in nut 7.

To reduce the press in width and the amount of metal required for the manufacture of the frame it is advantageous to use one auxiliary hydraulic cylinder 29 (FIG. 4) for rotation of the die holder 33. The auxiliary hydraulic cylinder in question is preferably arranged symmetrically with the hydraulic cylinder 35 provided for translatory motion of the die holder 33. This type of press construction is shown in FIG. 4. Initially, the top ram 25 and the bottom ram 26 occupy an uppermost position. The screw 28 is accommodated in the cavity 31 of the rod 30 incorporated in the hydraulic cylinder 29 intended for rotation of the die holder 33. Owing to this fact, the clearance formed between the upper crosshead 22 and the top ram 25 has a minimum size, which makes it possible to reduce the press frame in height.

To bring the die holder 33 closer to the workpiece, positioned on the crosshead 23, a low-pressure fluid is delivered from the fluid source 14 to the hydraulic cylinder 35, whereby the frame, formed by the traverse 36, tie rods 38 and ram 26, is brought down together with the die holder 33 and screw 28. The latter is freely removed from the nut 27 and rotates in the supporting bearing 34. To prevent the ram 25 from going down, a preset pressure is maintained in the rod end of the hydraulic cylinder 29 so as to retain the ram 25 in initial position.

The working stroke is performed by means of a high-pressure fluid delivered from the fluid source 14 to the hydraulic cylinder 35, while the rod end of the hydraulic cylinder 29 is brought in communication with a drain pipe, whereby the ram 25 is permitted downward movement. At this moment a clearance "a" is formed between the rams 25 and 26 of a size sufficient to obtain a preset angle of rotation of the die holder 33. The fluid pressure in the hydraulic cylinder 35 is transmitted through the agency of the press frame and supporting bearing 34 to the die holder 33 which, during its downward movement, deforms the workpiece by means of an advancing tool. This force is permitted to extend as fast as the frame and is not transmitted to the stand formed by the upper and lower crossheads 22 and 23, as well as by the uprights 24. Once a preset pressure is achieved, the fluid pressure gauge 18 is operated to send a signal in response to which the pressure valve is opened to permit the inflow of high-pressure fluid to the hydraulic cylinder 29, whereby its rod 30 is forced to move downward together with the ram 25. The nut 27, fixed in the ram 25, overtakes the screw 28, thereby causing its rotation and, consequently, that of the die holder 33. To overcome torque M, the force $P_3$ is to be applied to the ram 25, hence $$P_3 = M\frac{2\pi}{S} \tag{7}$$

This force is taken up by the stand of the press. The force $P_3$, added to the force $P_4$ of the hydraulic cylinder 35, overcomes resistance to the translatory motion of the die holder 33.

In the given press construction the movable links of the hydraulic cylinders 29 and 35 are guarded against rotation, which provides for reliable sealing of these hydraulic cylinders.

Axial arrangement of the hydraulic cylinders 29 and 35 prevents skewing of the rams 25 and 26.

Figure 2:
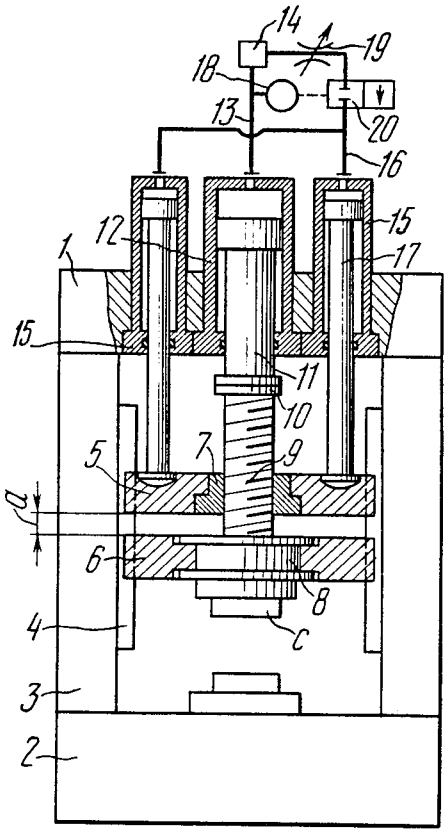
FIG. 2 is a longitudinal view of a hydraulically operated press according to the invention.

The hydraulic press shown in FIG. 5 operates in a similar manner as the hydraulic press shown in FIG. 2.

By reason of relatively small clearance "a" between the opposite butt ends of the nut 7 and the die holder 41, this press, unlike the one shown in FIGS. 2 to 4, is preferable for the production of forgings which do not require great angles of rotation of the die holder 41.

This press may be suitably used for three-impression forging which includes upsetting, forging proper, and cutting-off operation. The dies "d" and "e" of the first and third stages in the three-impression forging are preferably fixed to the ram 40 coaxially with the rods 17 of the hydraulic cylinders 15, and the die "C" of the second stage to the die holder 41 coaxially with the rod 11 of the hydraulic cylinder 12. This makes it possible to produce a finished forging at one and the same press, with the press parts undergoing relatively small skewing of the ram 40.

Let us now deal with the operation of crank presses. Prior to operation of the press (shown in FIGS. 6 and 7) the ram 47 occupies an uppermost position, the shaft 53 is held in place by means of a brake, and the clutch 57 is disengaged. When the press is put in operation, the brake 56 is retracted to release the shaft 53, and the clutch 57 enables its coupling to an electric motor (not shown). As the shaft 53 is set in motion, its eccentrics 52 and 54 are operated to transform, together with the connecting rods 51 and 55, the rotary motion of the shaft 53 into translatory motion of the ram 47, linked with the lateral connecting rods 55, and of the die holder 50 connected through the screw 49 to the central connecting rod 51. As the top die "C" comes in contact with a workpiece, its deformation is started. At this moment a clearance "a" is formed between the butt ends of the die holder 50 and the nut 48 of a size sufficient for the production of a forging. This clearance is obtained by shifting the eccentrics 54 of the lateral connecting rods 55 relative to the eccentric 52 of the central connecting rod 51 in the direction opposite to the direction of rotation of the shaft 53.

In the course of forging, the travelling speed of the die holder 50, connected by the screw 49 to the central connecting rod 51, will decrease. With the eccentrics 54 offset relative to the eccentric 52, the travelling speed of the ram 47, and that of the nut 48, will surpass the travelling speed of the screw 49, which causes rotation of the die holder 50. It should be observed that the speed of its rotation will increase toward the end of forging. As the ram 47 and the screw 49 perform their downward movement at different speeds, the die holder 50 is thereby permitted its rotary and translatory motions, with the rotary to translatory motion ratio increasing in the course of deformation of the workpiece, especially at the final stage of forging. This leads to a sharp decrease in peak deforming forces at the stage of final forging, as is shown in FIG. 1 (curve 4).

Rotation of the die holder brings about a change in the conditions of contact friction in the direction of lower resistance to the radial flow of metal, and results in tangential shear strain lowering the bearing capacity of the metal layer under deformation. This brings down the force to forge, the intensity of which is increased with rotation of the working tool. With the gearing of the above-described presses it becomes feasible to ensure the greatest possible reduction in the force to forge at the end of the working stroke of the die holder, as could be seen from curves 2, 3 and 4 shown in FIG. 1. Comparing the curve 1 with the curve 4 shows that the diagram of technological forces at the press with a rotating die holder is different from that obtained at the press with a die holder performing translatory motion. If this diagram reaches its peak at the end of forging, the forging force in the described press even decreases in the final stage. This ensures high operating reliability of both the parts of the press and its die.

In the above-described press construction the simplest type of mechanical linkage has been provided between the lateral connecting rods 55 coupled to the ram 47 with the built-in nut 48 and to the shaft 53, which contributes to high operating reliability and structural simplicity of the press as a whole.

The crank press shown in FIG. 8 operates in a similar manner.

When the press is put in operation, the clutches 57 and 70 are simultaneously actuated to cause rotation of the shafts 61 and 62, their speeds of rotation being equal due to similar drives (not shown) provided therefor. This is also ensured by the gearing formed by the gear wheels 65, 66 and 67, 68, as well as by the shaft 69, providing for coupling of the shafts 61 and 62. The main shaft 61 and the additional shaft 62 have independent drives, with the drive of the main shaft 61 accumulating a sufficient amount of kinematic energy to enable axial deformation of the forging with the drive of the additional shaft enabling rotation of the die holder 50. In this way the main shaft 61 is unloaded along with the clutch 57 and other members of its drive. The in-step rotation of the main shaft 61 and additional shaft 62 is effected by coupling the former and the latter through a gear drive, which is space-saving unlike any power transmission.

The rotary motion of the shafts 61 and 62 is transformed by means of the eccentrics 52, 54 and connecting rods 51, 63 into translatory motion of the screw 49 and the die holder 50 connected therewith, as well as of the ram 64 with the built-in nut 48. To provide the clearance "a" between the butt ends of the die holder 50 and nut 48, different angles $\alpha_2$ and $\alpha_3$, such as shown in FIG. 9, are respectively formed by the eccentrics 54 of the additional shaft 62 and by the eccentric 52 of the main shaft 61 with the geometric axis of the press. Owing to this fact, the travelling speed of the nut 48 during forging is greater than that of the screw 49, which causes accelerated rotation of the die holder 50 at the end of forging.

Advantageously, a cam 99 (FIG. 8) is mounted on the additional shaft 62 coaxially with the die holder 50 for interaction with a roller 100 connected with a pusher 101 provided to push out a finished forging. The press is thus rendered more simple in construction since it requires no special pushing device or a system for its in-step operation with an actuator.

The above-described construction of the crank press makes it possible to unload the main shaft 61 and the linking members of its drive, to reduce the press in width, and to increase its rigidity.

The crank press shown in FIGS. 10 to 13 operates in a similar manner as the crank presses described hereinabove. As the clutch 57 is switched on, the screw 74 is acted upon by the connecting rod 73 to start its downward movement, with the connecting rod 73 performing a complex motion. The pin 75, fixed on the latter, is moved downwardly in the left-hand direction (as viewed in the drawing) thereby acting on the lateral connecting rods 71. The latter cooperate with the ram 76 and thus cause the nut 48 fixed therein to move downward. The travelling speed of the screw 74 is lowered toward the end of forging, while that of the nut 48 is increased. This difference in the speeds of the nut 48 and the screw 74 makes for rotation of the screw 74 and of the die holder 50, whereby forging is performed along with twisting. This press construction ensures precision forging largely due to relatively high rigidity of the press.

In the crank presses shown in FIGS. 14 to 24, translatory motion of the ram 47 with the built-in nut 48 is effected through cooperation of the rockers 83 (FIG. 16), 87 (FIG. 19) or 97 (FIG. 23), which perform rocking motion relative to the axis of the eccentric shaft 77, with lateral connecting rods 78 coupled to the ram 47. The rocking motion is transmitted to these rockers from the central connecting rod 82 which is connected through the pin 85 to the intermediate link 86 (FIG. 15), 91 (FIG. 18) or 93 (FIG. 22) imparting motion to the rockers. Such kinematic linkage of the intermediate links with the rockers, in male contact with the shaft 77, permits the nut 48 to travel at a greater speed than the screw 49 in the course of deformation, which makes it possible to combine the forging operation with twisting. By selecting an appropriate place at which the pin 85 is fixed to the central connecting rod 82, the lengths of the arms of the rockers embracing the shaft 77 and of the additional rocker 89, as well as their rotation about the shaft 77 and the pin 90, it is possible to vary the speed of the nut 48 relative to the screw 49, thereby obtaining optimal parameters of forging.

As compared to widely used presses with translatory motion of a die holder having similar force, the described press has a far more extensive production range. In other words, it is suitable for the production of forgings greater in diameter or having thinner discs. On the other hand, to produce similar forgings in the known presses, it would require a 2- to 5-fold increase in the force to forge, as well as 3- to 7-fold increase in weight, much greater floor space, and appreciable increase in the production efficiency.

Although the press chosen as the prototype of this invention is provided with a rotating tool, its rated force, as well as dimensions and weight, are similar to those of known presses with translatory motion of the die holder. In addition, due to small torsion angles, the production efficiency of the prior-art press is much lower than that of the press according to the present invention.

The hydraulic press of 2 Mn, such as shown in FIG. 2, has been tested for production efficiency in upsetting and forging of cold lead specimens, as well as hot specimens from copper, aluminium and steel. For the sake of comparison, the specimens underwent upsetting and forging at one and the same force without twisting. Where upsetting of lead specimens was followed by twisting, the upset force was decreased over 20 times; in upsetting of hot specimens from ferrous and nonferrous metals the upset force was decreased 2- to 5-fold. In the course of combined forging and twisting, the impression of a die was uniformly filled with metal and the forgings had a flash uniformly distributed over the entire perimeter.

What is claimed is:

1. A press comprising two crossheads spaced some distance apart one from another; uprights adapted to interconnect said crossheads; said crossheads and uprights forming a frame of said press; a first ram mounted between said uprights for translatory movement relative thereto; a nut with a non-self-stopping thread carried in said first ram; a first drive for translatory motion of said first ram; a second ram mounted for translatory movement between said uprights; a die holder rotatably mounted in said second ram for translatory motion therewith and for rotation; a screw rigidly connected to said die holder and operatively connected with said nut, thereby forming therewith a kinematic couple; a second drive operatively connected to said screw to enable its translatory motion jointly with said second ram; means for interconnecting said first drive and said second drive to cause said second drive to become operative after said first drive and after the achievement of a predetermined stamping force in a workpiece; said first and second rams being initially in spaced relationship with a clearance formed therebetween sufficient to permit a specified angle of rotation of said die holder during translatory motion of said first ram relative to said second ram wherein said nut is caused to move toward said die holder.

2. A press comprising: two crossheads spaced some distance apart one from another; uprights adapted to interconnect said crossheads; said crossheads and uprights forming a frame of said press; a first ram mounted for translatory movement between said crossheads and along said uprights; a nut with a non-self-stopping thread carried in said first ram; a second ram mounted for translatory movement between said crossheads and along said uprights; a die holder rotatably mounted in said second ram for translatory motion therewith and for rotation relative thereto; a screw rigidly connected to said die holder and operatively connected with said nut thereby forming therewith a kinematic couple; drive means including a main hydraulic cylinder for translatory motion of said die holder jointly with said second ram; auxiliary drive means including at least one auxiliary hydraulic cylinder for translatory motion of said first ram and said nut, said main hydraulic cylinder including a movable rod connected to said first ram; a pressurized fluid source; pressure line means adapted to communicate said main hydraulic cylinder and said at least one auxiliary hydraulic cylinder with said pressurized fluid source; said at least one auxiliary hydraulic cylinder being controlled from said main hydraulic cylinder for translatory motion of said die holder; said first and second rams being initially in spaced relationship with a clearance formed therebetween of sufficient size to permit a specified angle of rotation of said die holder during translatory motion of said first ram relative to said second ram.

3. A press as claimed in claim 2, wherein said auxiliary drive means includes two auxiliary hydraulic cylinders to actuate said first ram, said auxiliary hydraulic cylinders being arranged symmetrically with said main hydraulic cylinder for imparting translatory motion to the die holder on said first ram.

4. A press as claimed in claim 2, including a fluid pressure gauge positioned in said pressure line means communicating said main hydraulic cylinder for translatory motion of the die holder with said pressurized fluid source, and said pressure line means communicating said at least one auxiliary hydraulic cylinder with said pressurized fluid source includes a variable orifice and a pressure valve responsive to a signal from said fluid pressure gauge.

5. A press as claimed in claim 2, wherein said pressure line means communicating said main hydraulic cylinder for translatory motion of the die holder passes through at least one auxiliary hydraulic cylinder to bring the rod end thereof into communication with the head end of said main hydraulic cylinder for translatory motion of the die holder, the ratio of the cross-sectional area of the head end of said main hydraulic cylinder to the cross-sectional area of the rod end of said at least one auxiliary hydraulic cylinder being equal to the ratio of the angular velocity of said die holder to its translatory velocity.

6. A press as claimed in claim 2, wherein one auxiliary hydraulic cylinder is provided to actuate said first ram, said auxiliary hydraulic cylinder being arranged on one of said crossheads coaxially with said main hydraulic cylinder mounted on the other crosshead, and a supporting bearing positioned between said second ram and the die holder.

7. A press as claimed in claim 1, wherein both rams are interconnected by said screw and are initially spaced by a clearance of sufficient size between the opposed ends of the nut and of the die holder to permit a specified angle of rotation of the die holder by said screw.

* * * * *